US005345619A

United States Patent [19]

Harrington

[11] Patent Number: 5,345,619

[45] Date of Patent: Sep. 13, 1994

[54] COMBINATION TOILET AND SWIVEL URINAL

[76] Inventor: Richard Harrington, One Glazer La., Levittown, N.Y. 11756

[21] Appl. No.: 118,521

[22] Filed: Sep. 9, 1993

[51] Int. Cl.[5] ..... E03D 13/00

[52] U.S. Cl. ..... 4/341

[58] Field of Search ..... 4/340–342, 4/314

[56] References Cited

U.S. PATENT DOCUMENTS

| | | | |
|---|---|---|---|
| 3,500,480 | 3/1970 | Michal | 4/341 X |
| 3,735,428 | 5/1973 | Olivero | 4/341 |
| 5,134,728 | 8/1992 | Strum | 4/341 X |

FOREIGN PATENT DOCUMENTS

| | | | |
|---|---|---|---|
| 3742760 | 8/1988 | Fed. Rep. of Germany | 4/340 |
| 2434242 | 4/1980 | France | 4/312 |

*Primary Examiner*—Charles E. Phillips
*Attorney, Agent, or Firm*—Michael I. Kroll

[57] ABSTRACT

A combination toilet and swivel urinal is provided and consists of a toilet having a bowl and a tank on the back. A urinal is hinged on a swivel to the side of the tank. The urinal is fluidly connected between the tank and the bowl of the toilet. The urinal can swing out from the side of the tank to a useable position and can swing back out of the way to a stored position.

4 Claims, 2 Drawing Sheets

COMBINATION TOILET AND SWIVEL URINAL

BACKGROUND OF THE INVENTION

1. Field of the Invention

The instant invention relates generally to plumbing fixtures and more specifically it relates to a combination toilet and swivel urinal.

2. Description of the Prior Art

Numerous plumbing fixtures have been provided in prior art that are adapted to be both the terminals of the water supply and the beginnings of the sewage systems. They control to a large extent both the quantity of water which must be furnished and the amount of sewage which must be carried away. While these units may be suitable for the particular purpose to which they address, they would not be as suitable for the purposes of the present invention as heretofore described.

SUMMARY OF THE INVENTION

A primary object of the present invention is to provide a combination toilet and swivel urinal that will overcome the shortcomings of the prior art devices.

Another object is to provide a combination toilet and swivel urinal in which the urinal is fluidly connected to the toilet making the fixture ecologically economical by being a water saver, more sanitary with less odor and no splatter around the toilet bowl or seat.

An additional object is to provide a combination toilet and swivel urinal in which the urinal swings out from the toilet when to be used and swings back out of the way and out of sight when not being used, causing no noise and no embarrassment to the person using the urinal.

A further object is to provide a combination toilet and swivel urinal that is simple and easy to use.

A still further object is to provide a combination toilet and swivel urinal that is economical in cost to manufacture.

Further objects of the invention will appear as the description proceeds.

To the accomplishment of the above and related objects, this invention may be embodied in the illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
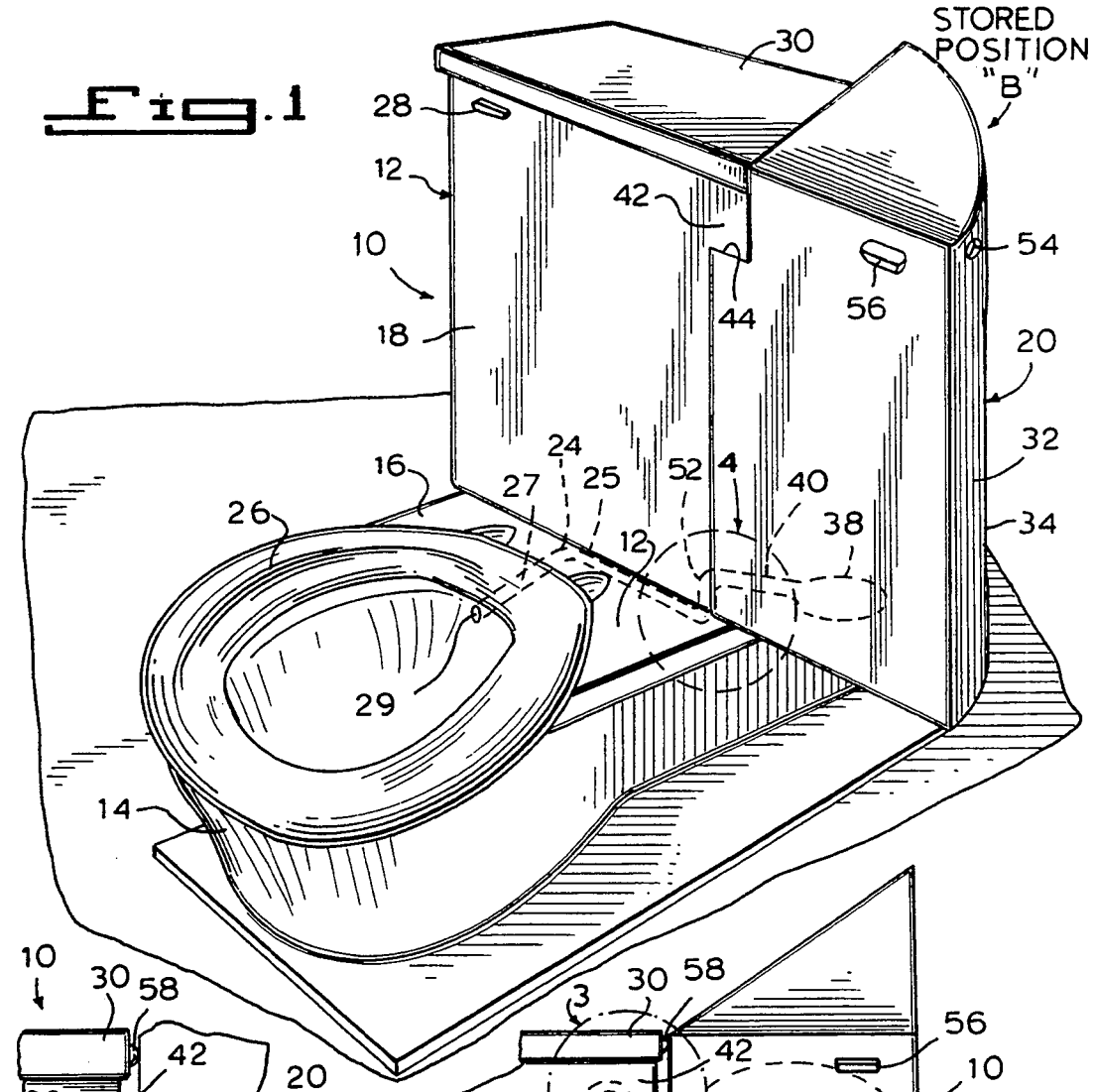
FIG. 1 is a perspective view of the instant invention with the urinal in the swung back non use position.
Figure 3:
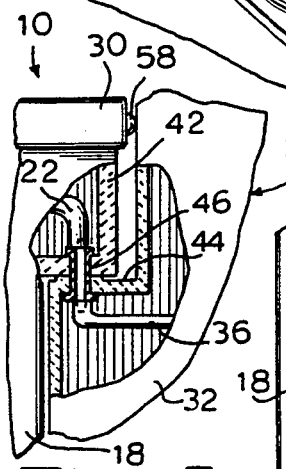
FIG. 3 is an enlarged detail view as indicated by arrow 3 in FIG. 2, with parts broken away and in section showing the upper hollow hinge pin in greater detail.
Figure 2:
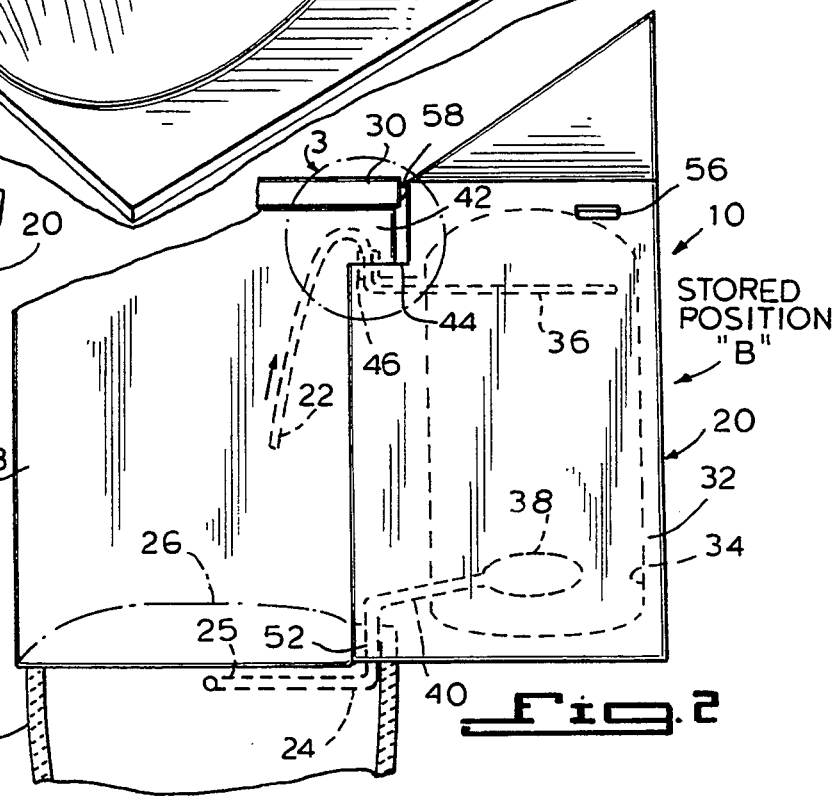
FIG. 2 is a front view thereof with parts broken away.
Figure 6:
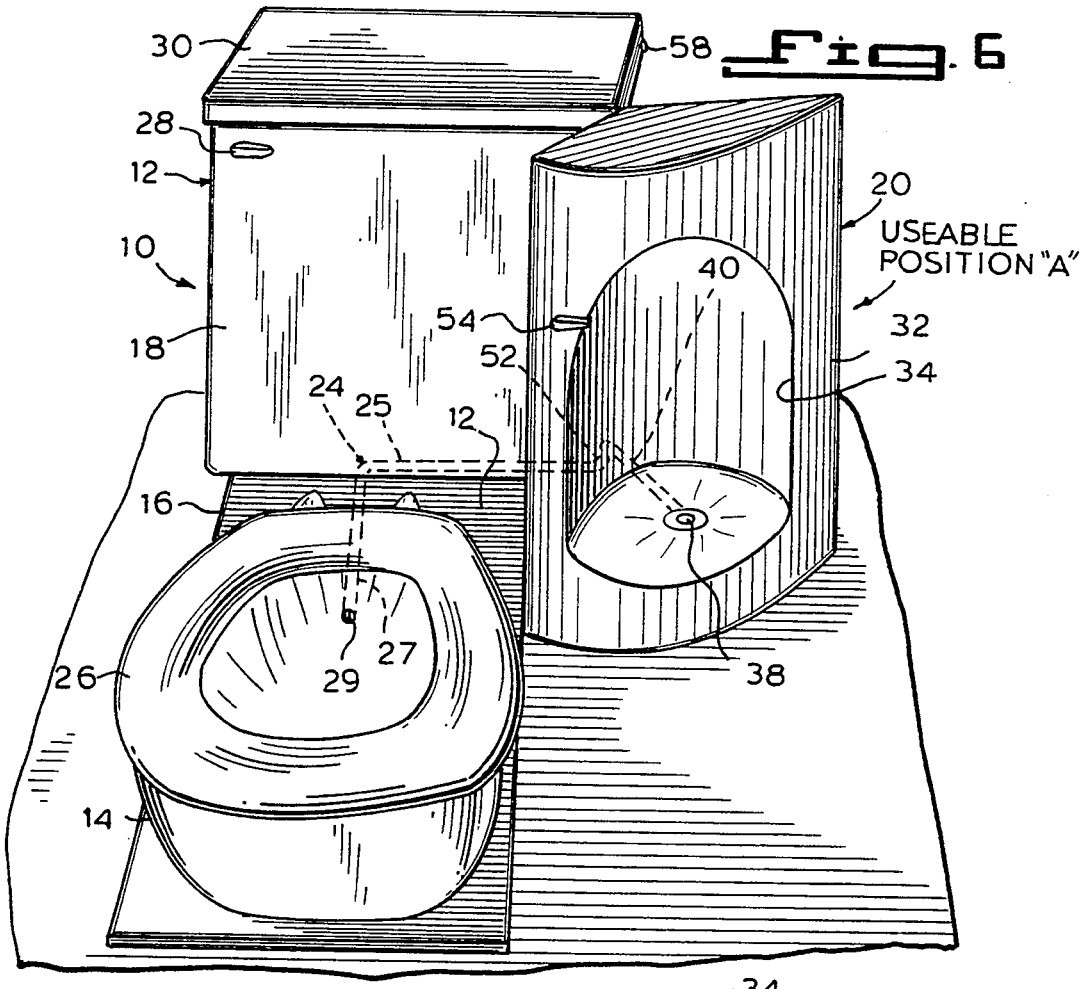
FIG. 6 is a perspective view of the instant invention with the urinal in the swung out in use position.
Figure 4:
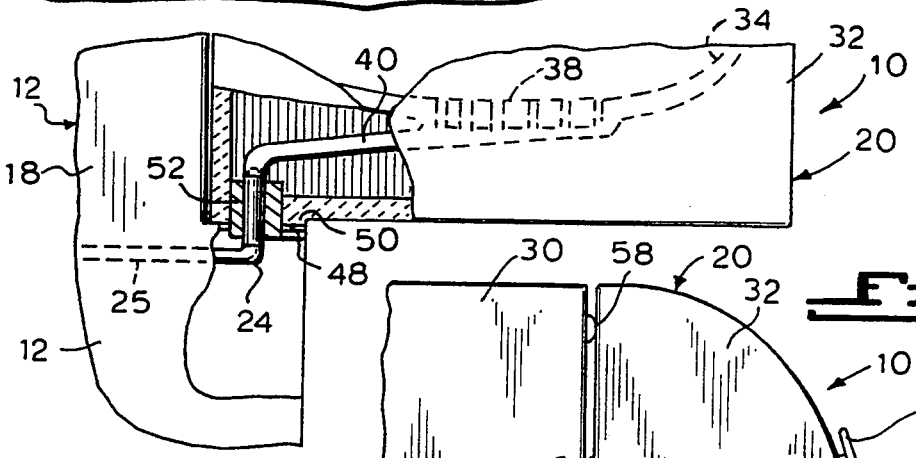
FIG. 4 is an enlarged detail view with parts broken away and in section showing the lower hinge pin in greater detail.
Figure 5:
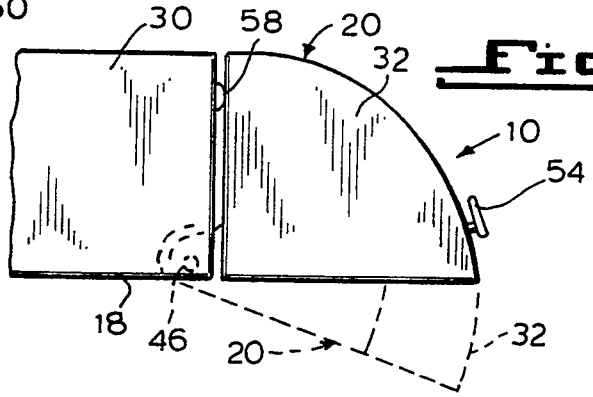
FIG. 5 is a top view showing how the urinal swings about the toilet tank.

Turning now descriptively to the drawings, in which similar reference characters denote similar elements throughout the several views, the Figures illustrate a combination toilet and swivel urinal 10 consisting of a toilet 12 having a bowl 14 and a tank 18 on the back of the toilet 12. A urinal 20 is hinged on a swivel to the side of the tank 18. The urinal 20 is fluidly connected between the tank 18 and the bowl 14 of the toilet 12. The urinal 20 can swing out from the side of the tank 18 to a useable position "A", as best shown in FIG. 6 and can swing back out of the way to a stored position "B", as best shown in FIG. 1.

A water feeder tube 22 in the tank 18 fluidly enters the top of the urinal 20, while a waste tube 24, being made up of a first substantially horizontal line 25 that connects to a second substantially horizontal line 27 that runs through the toilet 12 and exists in an orifice 29 in the bowl 14. This waste tube 24 fluidly connects the urinal 20 to the toilet 12. Line 40 is movably connected to line 25 by a swivel hinge 52. The first substantially horizontal line 25 is substantially horizontal to the second substantially horizontal line 27 and lies substantially in the same plane. All toilets come with an integral trap when the bowl is being casted and this should be known by those in the art as common knowledge. A seat 26 is hinged to the bowl 14. A toilet flush handle 28 is on the front of the tank 18 for operating a flush mechanism (not shown) in the tank 18. A lid 30 on top of the tank 18 is for covering the flush mechanism in the tank 18.

The first and second substantially horizontal lines 25 and 27 are only substantially horizontal because the liquid from the urinal 20 is gravity free so a slight incline is necessary.

The urinal 20 further includes a stall 32 having a front basin aperture 34. A flush pipe 36 is in the top of the front basin aperture 34 of the stall 32. The flush pipe 36 is fluidly connected to the water feeder tube 22. A drain 38 is in the bottom of the front basin aperture 34 of the stall 32. A drain tube 40 fluidly connects the drain 38 to the waste tube 24 in the bowl 14.

The tank 18 of the toilet 12 has an upper side overhang portion 42, while the stall 32 of the urinal 20 has an upper side offset portion 44. An upper hollow hinge pin 46 extends between the upper side overhang portion 42 of the tank 18 and the upper side offset portion 44 of the stall 32. The upper hollow hinge pin 46 is fluidly connected between the water feeder tube 22 in the tank and the flush pipe 36 in the stall 32.

The bowl 14 of the toilet 12 has an aperture 48 directly below the upper side overhang portion 42 of the tank 18. The stall 32 of the urinal 20 has an aperture 50 in the bottom directly above the aperture 48 in the toilet 12. A lower hollow hinge pin 52 is in the aperture 48 in the rim 16 and in the aperture 50 in the bottom of the stall 32. The lower hollow hinge pin 52 is fluidly connected between the drain tube 40 in the stall 32 and the waste tube 24 in the toilet 12.

A urinal flush handle 54 is on the front of the stall 32 for operating the flush pipe 36. A hand grip 56 is on the back of the stall 32 so that a person can hold the hand grip and manually swivel the stall 32 of the urinal 20 on the upper hollow hinge pin 46 and on the lower hollow hinge pin 52 to its useable position "A" and its stored position "B". A bumper 58 is affixed to the side of the toilet tank lid 30 over the upper side overhang portion 42 of the tank 18 to act as a padding when the stall 32 is swiveled back to its stored position "B" against the tank 18.

The tank 18 and the stall 32 are both elongated and of the same general height so that the stall 32 is high enough to be utilized in its swung out useable position "A".

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

| LIST OF REFERENCE NUMBERS | |
|---|---|
| 10 | combination toilet and swivel urinal |
| 12 | toilet |
| 14 | bowl |
| 18 | tank |
| 20 | urinal |
| 22 | water feeder tube |
| 24 | waste tube |
| 25 | first substantially horizontal line of the waste tube 24 |
| 26 | seat on 16 |
| 27 | second substantially horizontal line of the waste tube 24 |
| 28 | toilet flush handle on 18 |
| 29 | exit hole in bowl 14 |
| 30 | lid |
| 32 | stall |
| 34 | front basin aperture in 32 |
| 36 | flush pipe |
| 38 | drain |
| 40 | drain tube |
| 42 | upper side overhang portion in 18 |
| 44 | upper side offset portion in 32 |
| 46 | upper hollow hinge pin |
| 48 | aperture in 16 |
| 50 | aperture in 32 |
| 52 | lower hollow hinge pin |
| 54 | urinal flush handle on 32 |
| 56 | hand grip |
| 58 | bumper |

What is claimed is new and desired to be protected by Letters Patent is set forth in the appended claims:

1. A combination toilet and swivel urinal comprising:

a) a toilet having a bowl with a tank on the back of said toilet, a seat hinged to said bowl, a toilet flush handle on the front of said tank for operating a flush mechanism in said tank, a lid on top of said tank for covering the flush mechanism in said tank, said tank of said toilet having an upper side overhang portion;

b) a urinal hinged on a swivel to the side of said tank, said urinal being fluidly connected between said tank and said bowl of said toilet so that said urinal can swing out from the side of said tank to a useable position and can swing back out of the way to a stored position, said urinal further including a stall having a front basin aperture therein, flush pipe in the top of said front basin aperture of said stall, said flush pipe fluidly connected to said water feeder tube, a drain in the bottom of said front basin aperture of said stall, and a drain tube fluidly connecting said drain to said through said waste tube to said bowl; said stall of said urinal having an upper side offset portion; and c) means in said tank for feeding water to said urinal, said water feeding means including a water feeder tube in said tank fluidly connecting to the top of said urinal;

d) means in said bowl for carrying urine mixed with the water from said urinal into said bowl, said urine and water carrying means including a waste tube fluidly connecting the bottom of said urinal to said bowl; and e) an upper hollow hinge pin extending between said upper side overhang portion of said tank and said upper side offset portion of said stall, said upper hollow hinge pin being fluidly connected between said water feeder tube in said tank and said flush pipe in said stall.

2. A combination toilet and swivel urinal as recited in claim 1, further including:

a) said bowl of said toilet having an aperture directly below said upper side overhang portion of said tank;

b) said stall of said urinal having an aperture in the bottom directly above said aperture in said bowl; and c) a lower hollow hinge pin in said aperture in said toilet and in said aperture in the bottom of said stall, said lower hollow hinge pin being fluidly connected between said drain tube in said stall and said waste tube in said bowl.

3. A combination toilet and swivel urinal as recited in claim 2, further including:

a) a urinal flush handle on the front of said stall for operating said flush pipe;

b) a hand grip on the back of said stall so that a person can hold said hand grip and manually swivel said stall of said urinal on said upper hollow hinge pin and on said lower hollow hinge pin to its useable position and its stored position; and c) a bumper affixed to the side of said toilet tank lid over said upper side overhang portion of said tank to act as a padding when said stall is swiveled back to its stored position against said tank.

4. A combination toilet and swivel urinal as recited in claim 3, wherein said tank and said stall are both elongated and of the same general height so that said stall is high enough to be utilized in its swung out useable position.

* * * * *